United States Patent [19]

Marshall

[11] Patent Number: 4,696,140

[45] Date of Patent: Sep. 29, 1987

[54] CONNECTOR GUIDE SYSTEM FOR CONSTRUCTION WALLS

[76] Inventor: Robert H. Marshall, 22811 Orville Rd. East, Orting, Wash. 98360

[21] Appl. No.: 764,431

[22] Filed: Aug. 9, 1985

Related U.S. Application Data

[63] Continuation-in-part of Ser. No. 455,210, Jan. 3, 1983, abandoned.

[51] Int. Cl.[4] ..... E04B 2/20; E04B 1/02; E04C 1/10

[52] U.S. Cl. ..... 52/442; 52/564; 52/586

[58] Field of Search ..... 52/442, 586, 562, 564, 52/565, 425, 426, 437, 438

[56] References Cited

U.S. PATENT DOCUMENTS

| | | | |
|---|---|---|---|
| 904,588 | 11/1908 | Wightman | 52/426 |
| 932,261 | 8/1909 | Flynn | 52/564 |
| 2,881,613 | 4/1959 | Taylor et al. | 52/442 |
| 3,475,873 | 11/1969 | Steadman | 52/562 |
| 3,902,296 | 9/1975 | Thomas | 52/426 |

FOREIGN PATENT DOCUMENTS

| | | | |
|---|---|---|---|
| 103049 | 7/1926 | Austria | 52/564 |
| 804957 | 3/1951 | Fed. Rep. of Germany | 52/425 |
| 431882 | 3/1967 | Switzerland | 52/586 |
| 1228579 | 4/1971 | United Kingdom | 52/442 |

*Primary Examiner*—William F. Pate, III
*Assistant Examiner*—Michael Safavi
*Attorney, Agent, or Firm*—Delbert J. Barnard

[57] ABSTRACT

A connector guide system for the constructing of block walls (12) is disclosed. The blocks (14) are uniformly notched (20,22,24,26) to allow for the placement of connector guides (16). The guides include platforms (18) upon which the blocks (14) rest. Based on constant placement of notches (20,22,24,26) and connector guides (16), the wall (12) is constructed to allow for uniform mortaring.

7 Claims, 9 Drawing Figures

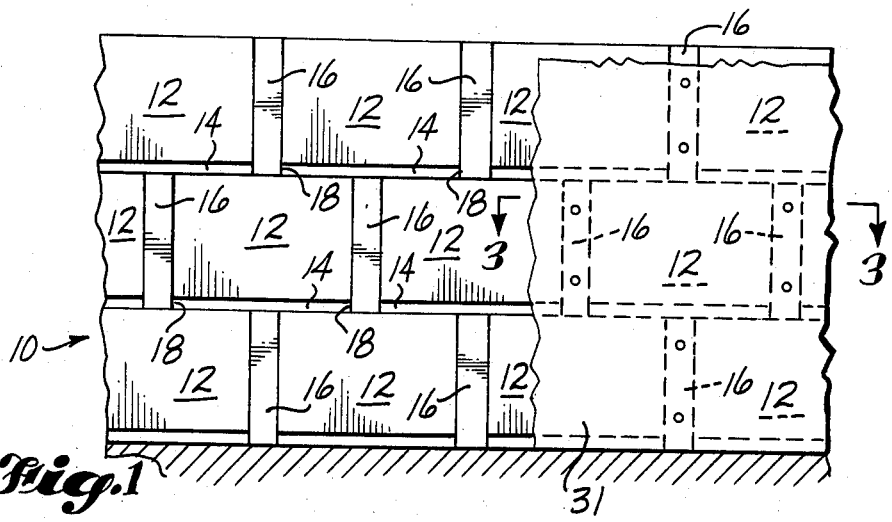
Fig. 1
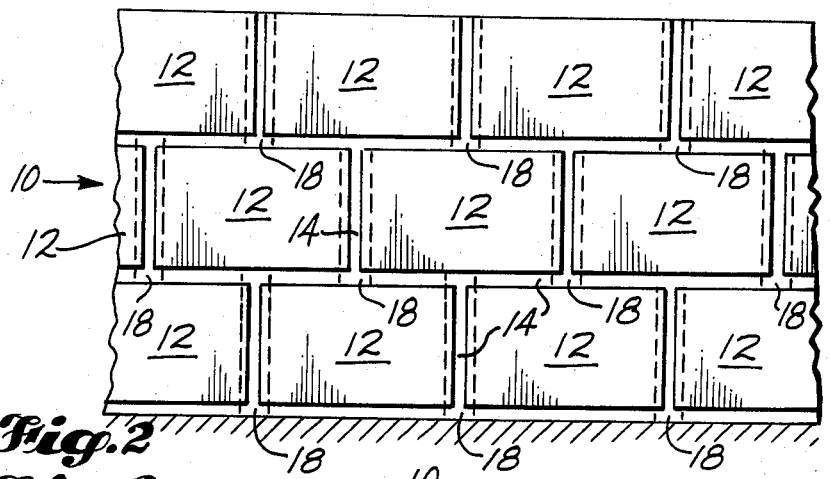
Fig. 2
Fig. 3
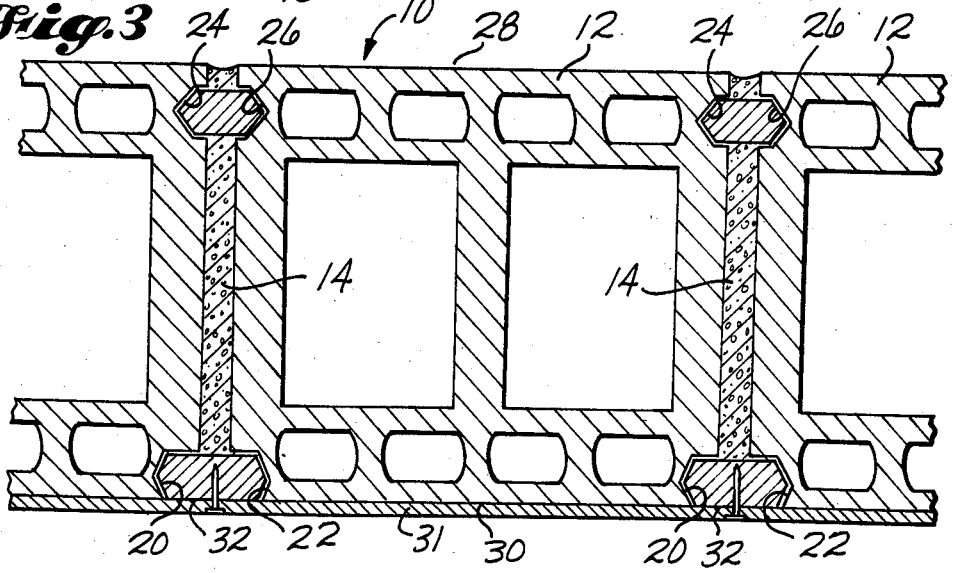

CONNECTOR GUIDE SYSTEM FOR CONSTRUCTION WALLS

CROSS REFERENCE TO RELATED APPLICATION

This application is a continuation-in-part of my copending application Ser. No. 455,210, now abandoned filed Jan. 3, 1983, and also entitled Connector Guide System for Construction Walls.

DESCRIPTION

1. Technical Field

This invention relates to the construction of block walls, and more particularly to the provision of a wall construction utilizing connector guides of a unique construction adapted to permit easy and rapid construction of a block wall, complete with uniform mortar joints.

2. Background Art

U.S. Pat. No. 4,334,397, granted June 15, 1982, to George R. Hitz, discloses the use of spacer elements between the blocks or brick of a masonry wall, for dictating and dimensions of the mortar spaces between the blocks. Some additional patents relating to spacer aids are listed and are, to a limited extent, discussed in this patent.

U.S. Pat. No. 2,392,551, granted Jan. 8, 1946, to James Roe; U.S. Pat. No. 3,936,987, granted Feb. 10, 1976, to Edward L. Calvin; and Swiss Pat. No. 431,882, published in 1967, inventor Rene Metzler, each discloses a block wall construction involving interlocks between the blocks and mortar joints.

The present invention relates to the provision of a wall construction utilizing mortar space defining elements which engage the blocks and provide a substantially true alignment of the blocks, in addition to spacing the blocks apart both vertically and horizontally by amounts to provide substantially uniform mortar joint space between the blocks.

3. Disclosure of the Invention

Basically, the wall construction of the present invention comprises a plurality of blocks, each of which has an exterior face, an interior face, two ends, and two vertical notches formed in each end of the block, one adjacent the exterior face and the other adjacent the interior face. A plurality of connector guides are provided, one at each end of each block. Each connector guide comprises a pair of vertically extending guide members, one for each notch. Each guide member has a portion which fits into its notch and each also includes a lower end of a platform leg which projects laterally below a portion of the block adjacent the notch. The two guide members are connected together by tie means. The connector guides position the blocks to provide a substantially true alignment of the blocks. They also space the blocks apart both vertically and horizontally by amounts to provide substantially uniform mortar joint spaces between the blocks.

In accordance with another aspect of the invention, the vertical notches adjacent the interior face of the blocks are at the interior corners of the blocks. The guide members in such notches present interior wall faces which are substantially flush with the interior wall faces of the blocks. This provides way of conveniently connecting surface material to the wall. The surface materials can be nailed or otherwise secured to the guide members in the interior corner notches.

In accordance with another aspect of the invention, the vertical notches adjacent the exterior faces of the blocks are offset inwardly from the exterior faces of the blocks, so that mortar joint spaces exist outwardly of the guide members which are within such notches.

In preferred form, the tie means for each connector guide comprises an upper connector member innerconnected between the upper ends of the guide members and a lower connector member interconnected between the lower ends of the guide members. In preferred form, the tie means may be in the form of metal rods with end portions which extend into the ends of the guide members.

Other more detailed aspects of the invention will be hereinafter described in connection with the illustrated embodiment of the invention.

Like parts are designated by like reference numerals throughout the several figures of the drawing, and:

BRIEF DESCRIPTION OF THE DRAWINGS

FIG. 1 is an elevational view of a fragmentary portion of a block wall, looking towards the interior side of such wall, and showing a fragmentary portion of an interior wall panel which is nailed to connector guides which are a part of the wall construction;

FIG. 2 is a view like FIG. 1, but looking towards the exterior side of the wall;

FIG. 3 is a fragmentary sectional view, taken substantially along line 3—3 of FIG. 1;

BEST MODES FOR CARRYING OUT THE INVENTION

Figure 4:
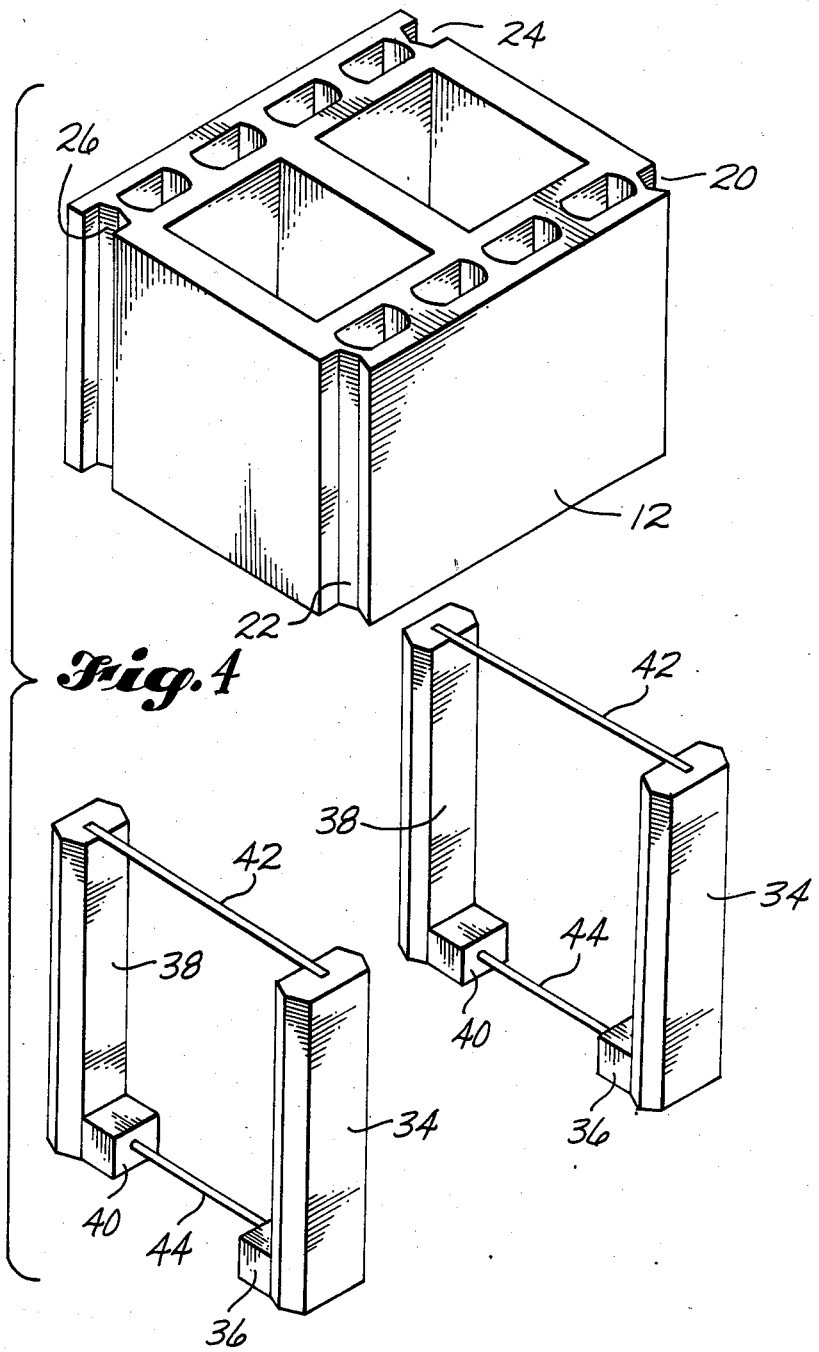
FIG. 4 is an exploded isometric view showing a block spaced in position from the connector guide structure which is provided at the opposite ends of the block.

FIG. 1 is a side view of a partial portion of a block wall 10. The block wall 10 comprises individual notched blocks 12. The notched blocks 12 are stacked to form the wall 10 having mortar joint spaces 14.

As set forth in FIG. 1, the notched blocks 12 are set in position by connector guides 16. The connector guides 16 are designed to position themselves on the sides of the notched blocks 12 Further, the connector guides 16 form a platform 18 upon which the combination of connector guides 16 and notched blocks 12 rest. Since the connector guides 16 are essentially uniform in size and configuration, a uniform positioning of the notched blocks 12 in relation to each other is established. Thus, as set forth on FIG. 1, the mortar joints 14 are uniform.

As shown in FIGS. 3–6 and 8, each notched block 12 includes four notches or recesses. In the interior face, are interior notches 20 and 22. The interior notches 20,22 run from top to bottom of the notched block. As illustrated in FIG. 3, interior notch 20 takes off the interior right hand corner of the notched block 12. Interior notch 22 takes off the interior left hand corner of the notched block 12.

The exterior notches 24 and 26 are positioned inward from the exterior face 28 of the notched block 12. The notches 24 and 26 for the exterior face run the length from top to bottom down the opposing sides of the notched block 12. The positioning of the exterior notches 24 and 26 inward from the exterior face 28 allows for mortar recesses 14, thereby allowing the user to place mortar in all of the joints. The mortar is allowed to thus seep into all recesses 14 until it comes into abutment with a connector guide 16.

As set forth previously, on the opposing interior face 30 complete corners of the notched block are taken away, thereby allowing the outer face 32 of the connector guides 16 to lie flush with the interior face 30 of the notched block 12. The advantage of allowing for the flush placement of the outer face 32 of the connector guide 16 with the interior face 30 of the notched blocks, is to allow for a uniform nailing surface in the interior wall formed by the notched blocks 12. For instance, a sheet of sheetrock 31 may be nailed flush with the cement blocks 12 and connector guides 16.

In FIG. 4, a detailed view of the connector guide 16 is illustrated.

As set forth in FIG. 4, an interior wall guide member 34 includes an interior wall guide platform leg 36, which extends horizontally from the interior wall guide member 34. The platform leg 36 runs the width of the interior wall guide member. Opposing the interior wall guide member 34 is exterior wall guide member 38. The exterior wall guide member 38 also includes exterior wall guide platform leg 40. The exterior wall guide platform leg 40 also extends horizontally from the exterior wall guide member 38. The interior wall guide platform leg 36 and the exterior wall guide platform leg 40 extend toward one another. Thus, the interior wall guide platform leg 36 extends toward the exterior wall and the exterior wall guide platform leg 40 extends toward the interior wall.

In the preferred embodiment, the interior wall guide 34 and the exterior wall guide member 38 are held in position by wires 42 and 44. The wires can be replaced, however, with other conventional means of holding the exterior and interior wall guides in position.

Figure 5:
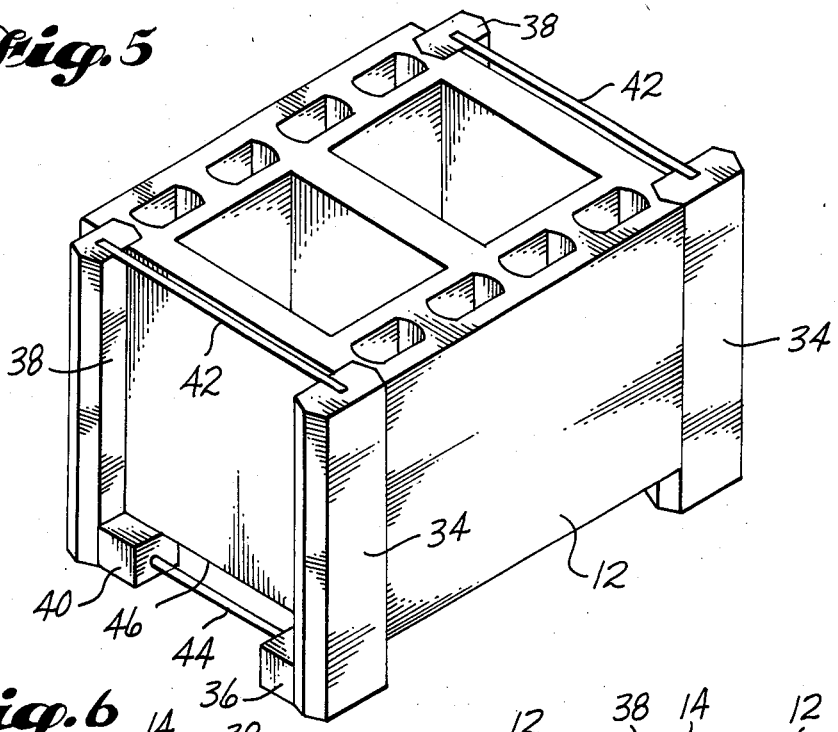
FIG. 5 is an isometric view of the components of FIG. 4, shown assembled together.
Figure 6:
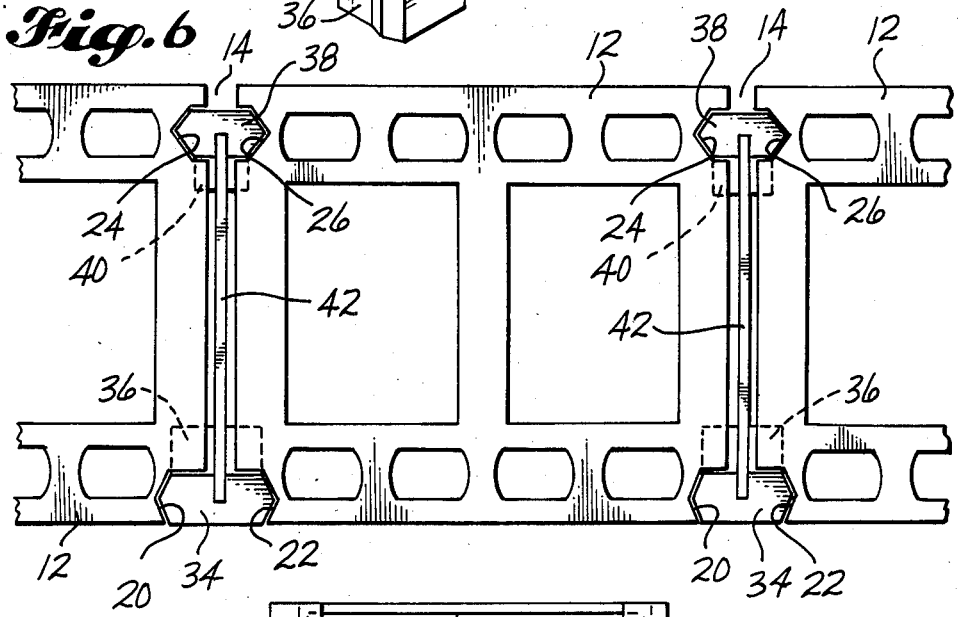
FIG. 6 is a top plan view of an upper course of a block wall in construction, with the mortar omitted.

In FIG. 5, a notched block 12 is shown resting on the interior wall guide 34 and exterior wall guide 38. As set forth in FIG. 5, the notched block bottom surface 46 merely rests on the interior wall guide platform leg 36 and the exterior wall guide platform leg 40. Further, the notched block 12 is positioned on either side of the wires 42 and 44. Thus, when the next notched block 12 rests on the same interior and exterior platform legs 36 and 40, the notched block will be positioned on the other side of the wire 42. (See FIG. 6.)

Thus, the first step is to place connector guides 16 on the opposing sides of the notched block 12. After this is completed, and mortar is placed in spaces 14, according to standard practice. The user merely places the notched block with connector guides on the notched blocks 12 which have already been formed into the wall 10.

On the next step, the user merely places a connector guide 16 on one side of the notched block 12 and does not place a connector guide 16 on the opposing side, allowing for the user to position this notched block 12 on the face of the connector guide 16 from the first notched block placed down. Since the notched blocks rest on the platforms 18 (i.e. 36,40) the user constructs a uniform wall.

On the exterior face 28, the mortar joints are uniform both vertically and laterally and mortar can be placed according to standard practice. Finally, since the interior wall guide member 34 and the exterior wall guide member 38 are held together by wires 42,44, insulation can be blown down the slot between the interior wall guide and the exterior wall guide of the connector guide 16.

Figures 8, 9:
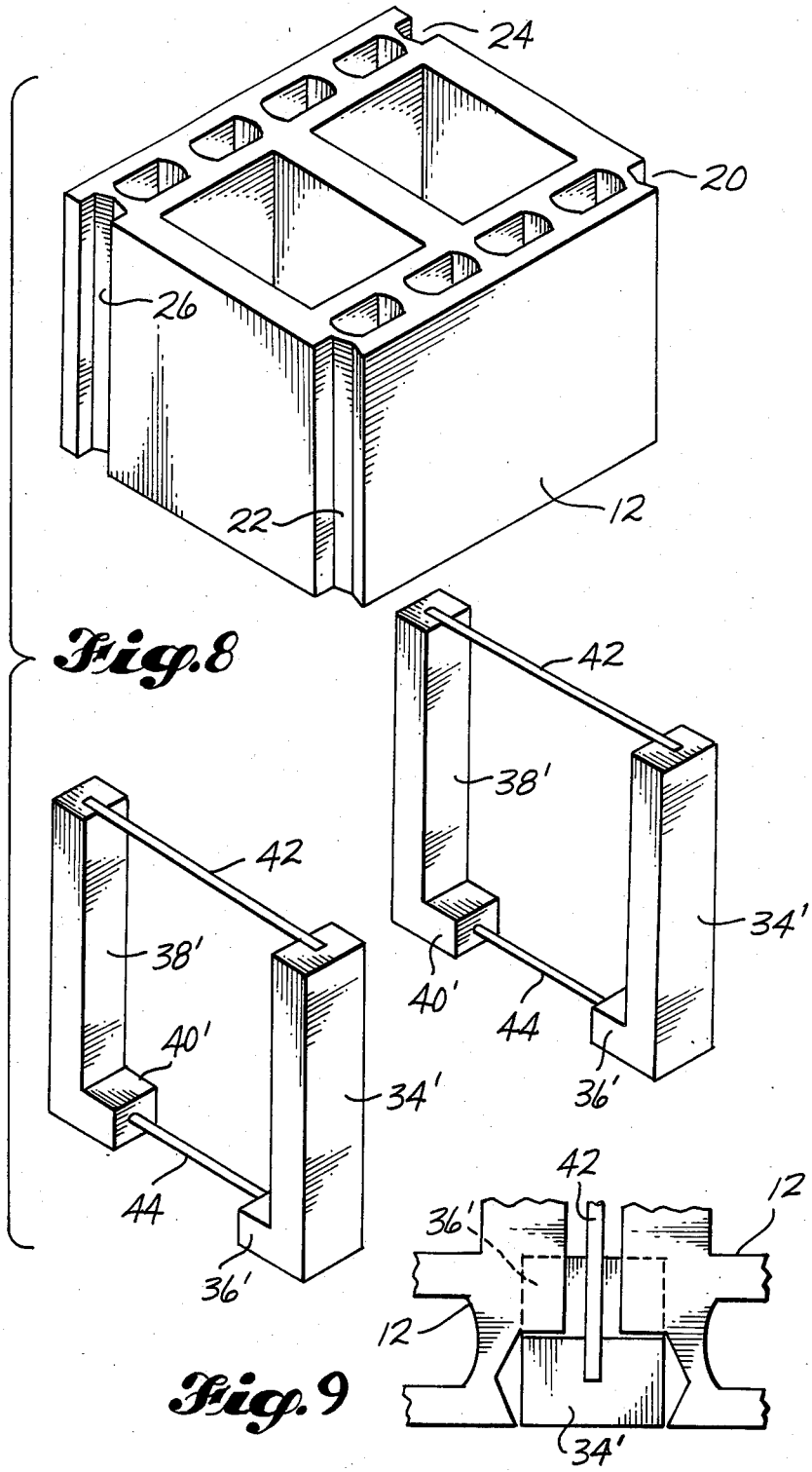
FIG. 8 is a view like FIG. 4, showing a modified construction of the guide members.
FIG. 9 is a fragmentary top plan view showing a guide member of FIG. 8 within a notch in a block.

FIGS. 1 and 3–6 show the sides of members 34,38 having a V-shape, conforming to the V-shape of the notches 20,22,24,26. FIGS. 8 and 9 show a modification. The sides of the members 34' and 38' are flat. This provides a space for mortar between the members 34',38' and the bases of the notches 20,22,24,26.

Figure 7:
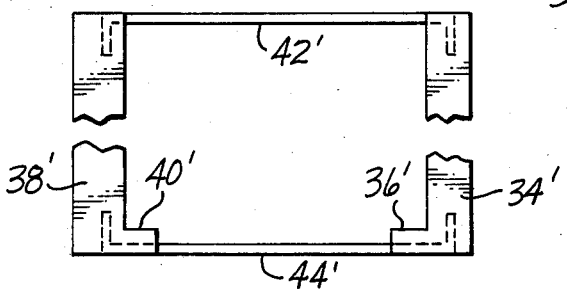
FIG. 7 is an elevational view of the upper and lower portions of a connector guide, showing a possible connection of the tie means to the guide members.

FIG. 7 shows that the ends of the wires 42,44 may be bent and embedded in the ends of the guide members 34,34',38,38'.

Although particular preferred embodiments of the invention have been disclosed above for illustrative purposes, it is to be understood that variations or modifications thereof which lie within the scope of the appended claims are contemplated.

What is claimed is:

1. A wall construction, comprising:

a plurality of blocks, each having an exterior face and an interior face, and two ends, and two vertical notches formed in each end of the block, one adjacent the exterior face and the other adjacent the interior face;

a plurality of connector guides, one at each end of each block, each connector guide comprising:

a pair of vertically extending guide members, one for each notch, each said guide member having a portion which fits into its notch, and each including a lower end platform leg which projects laterally below a portion of the block adjacent the notch, tie means interconnecting the two guide members;

said connector guides positioning the blocks to provide a substantially true alignment of the blocks and also spacing the blocks apart both vertically and horizontally by amounts to provide substantially uniform mortar joint spaces between the blocks;

wherein the tie means for each connector guide comprises an upper connector rod member having end portions embedded in the upper ends of the guide members and a lower connector rod member having end portions embedded in the lower ends of the guide member, and wherein the ends of the rod members are bent to extend longitudinally of the guide members.

2. A wall construction according to claim 1, wherein the vertical notches adjacent the interior face of the blocks are at the interior corners of the blocks, and the guide members in said notches present interior wall faces which are substantially flush with the interior wall faces of the blocks.

3. A wall construction according to claim 2, wherein the vertical notches adjacent the exterior faces of the blocks are offset inwardly from the exterior faces of the blocks, so that mortar joint spaces exist outwardly of the guide members within said notches.

4. A wall construction according to claim 1, wherein the vertical notches adjacent the exterior faces of the blocks, are offset inwardly from the exterior faces of the blocks, so that mortar joint spaces exist outwardly of the guide members within said notches.

5. A wall construction according to claim 1, wherein each guide member has oppositely directed portions, each of which fits into a separate notch of a separate block.

6. A wall construction according to claim 5, wherein the vertical notches adjacent the interior face of the blocks are at the interior corners of the blocks, and the guide members in said notches present interior wall faces which are substantially flush with the interior wall faces of the blocks.

7. A wall construction according to claim 6, wherein the vertical notches adjacent the exterior faces of the blocks are offset inwardly from the exterior faces of the blocks, so that mortar joint spaces exist outwardly of the guide members within said notches.

* * * * *